United States Patent [19]

Sasaki

[11] Patent Number: 4,931,170

[45] Date of Patent: Jun. 5, 1990

[54] METHOD FOR LIGHTENING PETROLEUM HYDROCARBON OIL BY DISTILLATION

[75] Inventor: Tadashi Sasaki, Tokyo, Japan

[73] Assignees: Seibu Oil Co., Ltd., Tokyo; Unique Chemical Consultant, Ltd., Osaka, both of Japan

[21] Appl. No.: 233,659

[22] PCT Filed: Nov. 28, 1987

[86] PCT No.: PCT/JP87/00925

§ 371 Date: Jun. 22, 1988

§ 102(e) Date: Jun. 22, 1988

[87] PCT Pub. No.: WO88/03942

PCT Pub. Date: Jun. 2, 1988

[30] Foreign Application Priority Data

Nov. 29, 1986 [JP] Japan ..... 61-283165

[51] Int. Cl.[5] ..... C10G 9/16; C07C 7/18

[52] U.S. Cl. ..... 208/348; 203/6; 208/48 R; 208/48 AA

[58] Field of Search ..... 208/48 R, 48 AA, 290, 208/293, 348, 106, 125; 585/833, 864, 950; 203/6, 7, 8

[56] References Cited

U.S. PATENT DOCUMENTS 2,658,864 11/1953 Ebel ..... 203/6
3,197,396 7/1965 Stedman ..... 208/48 AA
4,116,812 9/1978 Godar et al. ..... 208/48 AA

FOREIGN PATENT DOCUMENTS 2090798 1/1972 France .
985180 3/1965 United Kingdom ..... 208/48 AA

OTHER PUBLICATIONS

Abstract, Japanese Patent No. 56-103284(A), 8/18/81, (English translation).
Abstract, Japanese Patent No. 57-21487(A), 2/4/82, (English translation).
Abstract, Japanese Patent No. 57-7428(A), 1/14/82, (English translation).
Abstract, Japanese Patent No. 57-180692(A), 11/6/82, (English translation).
Abstract, Japanese Patent No. 58-34889(A), 3/1/83, (English translation).
Abstract, Japanese Patent No. 57-90093(A), 6/4/82, (English translation).
Abstract, Japanese Patent No. 62-207394(A), 9/11/87, (English translation).

*Primary Examiner*—Glenn Caldarola
*Attorney, Agent, or Firm*—Wegner & Bretschneider

[57] ABSTRACT

A method for lightening a petroleum hydrocarbon oil by distillation in which 1 part by weight or less of an organic compound having an active mercapto group therein is added to 100 parts by weight of the petroleum hydrocarbon oil when the petroleum hydrocarbon oil is lightened by a thermal treatment.

3 Claims, No Drawings

METHOD FOR LIGHTENING PETROLEUM HYDROCARBON OIL BY DISTILLATION

TECHNICAL FIELD

The present invention relates to lightening a petroleum hydrocarbon oil by purifying the same by a thermal treatment operation to produce materials useful in the fields of, for example, fuels. More specifically, it relates to a method for obtaining light fractions useful for fuels and the like by previously adding an organic compound having an active mercapto group therein to the petroleum hydrocarbon oil, followed by a thermal treatment, when the petroleum hydrocarbon oil is fractionated into each useful fraction by a distillation operation.

PRIOR ART

Heretofore, thermal cracking methods, catalytic cracking methods, and hydrogenating cracking methods have been used as methods for lightening petroleum hydrocarbon oils to produce materials useful in the fields of, for example, fuels and the like. In these methods, although hydrocarbon oils can be cracked at a high temperature by a thermal treatment to produce useful light fractions, polymerization reactions occur, simultaneously with the thermal cracking reactions, and polymerized heavy hydrocarbon compounds having a high molecular weight are obtained as by-products. Various proposals have been made for obtaining useful light fractions at a high yield by adding various additives to improve the yield of the light fractions in the above-mentioned methods, as follows:

(i) Methods of adding, as a thermal cracking radical stabilizer, for example, dialkyl thiocarbomic acids, diaryl thiocarbomic acids, etc., or organic phosphate esters, benzothiazoles etc., to petroleum heavy oils (see, for example, Japanese Unexamined Patent Publication (Kokai) No. 57-90093); and (ii) Methods of adding quinoline, tetrahydroquinoline, or a mixture thereof (see, for example, Japanese Unexamined Patent Publication (Kokai) No. 57-21487).

Nevertheless, a method for improving the lightening yield of a petroleum hydrocarbon oil only by a simple distillation operation has not been proposed until now.

SUMMARY OF THE INVENTION

Accordingly, the objects of the present invention are to obviate the above-mentioned problems in the state of the prior art and to provide a method for obtaining light fractions useful in the fields of, for example, fuels and the like, by an ordinary distillation operation not only from heavy residual oils but also from crude oils, without depending upon special catalytic and thermal cracking processes.

In accordance with the present invention, there is provided a method for lightening a petroleum hydrocarbon oil comprising the steps of: adding 1 part by weight or less, preferably 0.001 to 0.1 part by weight, more preferably 0.005 to 0.05 part by weight, of an organic compound having an active mercapto group therein to 100 parts by weight of a petroleum hydrocarbon; and carrying out a distillation operation by a thermal treatment.

BEST MODE OF CARRYING OUT THE INVENTION

The organic compounds having an active mercapto group therein usable in the present invention are preferably those in a liquid state at an ordinary temperature. Examples of such compounds are alkyl mercaptans such as octyl mercaptan, dodecyl mercaptan, dimercaptopropane, and dimercaptobutane; polyalkylene ether polythiols such as diethyleneglycol dimercaptane and triethylene glycol dimercaptan; esters of thiocarboxylic acid with monohydric-to polyhydric-alcohols, such as isooctyl thioglycolate, 2-ethylhexyl mercapto propionate, ethyleneglycol dimercaptopropionate, butanediol dimercaptoacetate, trimethylolpropane tris-mercaptoacetate, and pentaerythritol tetrakis-3-mercaptopropionate.

The petroleum hydrocarbon oils capable of being lightened according to the present method are not specifically limited. For example, various crude oils such as naphthenic crude oils, paraffinic crude oils, and mixtures thereof, as well as the topping residual oils and the vacuum distillation residual oils thereof, can be lightened. Especially, the present method is preferably applied to petroleum hydrocarbon oils such as crude oils having a low thermal history.

There are no specific limitations to distillation methods for lightening petroleum hydrocarbon oils according to the present invention and any conventional distillation methods can be used when carrying out the present invention. Briefly, the preferable operation conditions are those used by the conventional topping methods of crude oils except that the above-mentioned are added to the petroleum hydrocarbon oils at a preheating step before the distillation operation, to thoroughly mix the additives with the petroleum hydrocarbon oils.

In the practice of the present invention, the yield of light fractions useful in the fields of, for example, fuels and the like, can be increased in conventional distillation methods only by adding the above-mentioned organic compounds having an active mercapto group therein to the petroleum hydrocarbon oils, without making the thermal treatment conditions particularly severe.

The organic compounds having an active mercapto group therein to be used in the present invention very readily react with unsaturated bonds and cause an addition reaction to double bonds at an ordinary temperature or upon slight heating, to saturate the same. Accordingly, when the organic compound having an active mercapto group therein is added, various condensation polymerization reactions caused by radicals generated during the thermal treatment of petroleum hydrocarbon oils are suppressed and the propagation or growth of unsaturated compounds to the giant molecules is prevented.

EXAMPLE

The present invention will now be explained in detail with reference to, but is by no means limited to, the following Examples.

Example 1 (Distillation of Oman crude oil)

Fractionating tests of the crude oil were carried out by using a distillation apparatus according to ASTM-D2892. The fractionating test results are shown in Table 1. Experiment No. 1 is a comparative test in which an organic compound having an active mercapto group therein was not added to the crude oil. In Experiment Nos. 2 and 3, 0.01 part by weight and 0.10 part by weight of pentaerythritol tetrakis-3-mercaptopropionate were added, as the organic compound having an active mercapto group, to the crude oil, respectively. The crude oil used in the tests was Middle-East mixed crude oil mainly containing Oman crude oil.

TABLE 1

| Experiment No. | 1* | 2 | 3 |
|---|---|---|---|
| Yield of 360° C.-fraction (wt %) | 53.2 | 55.4 | 55.8 |

*Comparative Experiment

As is clear from the results shown in Table 1, the economical value of Experiment Nos. 2 and 3 according to the present invention is high when compared to the comparative experiment, i.e., Experiment No. 1, because the difference of 2 to 3% by weight in the yields of the light fractions is large, from the viewpoint of a large scale distillation treatment of crude oil.

Example 2 (Distillation of Topping Residual Oil)

Fractionating tests of topping residual oil were carried out by using a distillation apparatus according to ASTM-D 1160. The fractionating test results are shown in Table 2. Experiment No. 1 was a Comparative test, in which an organic compound having an active mercapto group was not used. In Experiment Nos. 2 and 3, the fractionating tests were carried out by adding trimethylolpropane tris-3-mercaptopropionate in an amount of 0.010 part by weight and 0.025 parts by weight, respectively, to the topping residual oil. The topping residual oil used was 360° C.-fraction of topping residual oil of Middle-East mixed crude oil mainly containing Khafji crude oil.

TABLE 2

| Experiment No. | 1* | 2 | 3 |
|---|---|---|---|
| 360° C.-530° C. (Vol %) | 40.5 | 42.5 | 41.8 |

*Comparative Example

As is clear from the results shown in Table 2, the increase of the yield of the vacuum light oil of 1 to 2% by volume was obtained in the case of Experiment Nos. 2 and 3, when compared to the Comparative Example (i.e., Experiment No. 1). This increase in the yield is useful for holding the necessary raw materials of the subsequent cracking process.

Example 3 (Distillation of Iranian Heavy Crude Oil)

The fractionating tests were carried out in the same manner as in Example 1, except that a crude oil mainly containing Iranian heavy crude oil was used in lieu of the crude oil mainly containing Oman crude oil.

The results obtained are shown in Table 3.

TABLE 3

| Experiment No. | 1* | 2 |
|---|---|---|
| Amount of additive added (wt. part) | None | 0.015 |
| Yield of 350° C.-fraction (Vol %) | 56.8 | 62.5 |

*Comparative Example

As shown in Tables 1 to 3, the yields of the light fractions were increased, when compared to each Comparative Example, by adding the organic compound having an active mercapto group to the petroleum hydrocarbon oils according to the present invention, followed by carrying out a conventional distillation operation.

I claim:

1. A method of lightening a petroleum hydrocarbon oil by distillation comprising adding 1 part by weight or less of at least one compound selected from the group consisting of pentaerythritol tetrakis-3-mercaptoprrionate, trimethylolpropane tris-3-mercaptopropionate, pentaerythritol tetrakis-mercaptoacetate, and trimethylolpropane tris-mercaptoacetate, to 100 parts by weight of the petroleum hydrocarbon oil when the petroleum hydrocarbon oil is lightened by a thermal treatment.

2. A method as claimed in claim 1, wherein the petroleum hydrocarbon oil is a crude oil or topping residual oil.

3. A method as claimed in claim 1, wherein the addition amount of the organic compound having an active mercapto group therein is 0.001 to 1 part by weight, based on 100 parts by weight of the petroleum hydrocarbon oil.

* * * * *